United States Patent [19]

Butler

[11] 3,946,839

[45] Mar. 30, 1976

[54] SUITCASE DEVICE

[75] Inventor: Robert C. Butler, Rancho Palos Verde, Calif.

[73] Assignee: The Raymond Lee Organization, Inc., New York, N.Y. ; a part interest

[22] Filed: Mar. 31, 1975

[21] Appl. No.: 563,626

[52] U.S. Cl. ..... 190/18 A; 190/58 B; 190/42

[51] Int. Cl.[2] ..... A45C 5/14

[58] Field of Search ..... 190/18 A, 58 A, 58 B, 51, 190/42, 57, 44; 317/123, 155.5

[56] References Cited

UNITED STATES PATENTS

| | | | |
|---|---|---|---|
| 497,557 | 5/1893 | Seyller | 190/18 A |
| 2,581,417 | 1/1952 | Jones | 190/18 A |
| 2,596,578 | 5/1952 | McIntyre | 190/18 A |
| 2,925,283 | 2/1960 | Stilger | 190/18 A |
| 3,513,952 | 5/1970 | Warner | 190/18 A |
| 3,842,953 | 10/1974 | Royet | 190/18 A |

*Primary Examiner*—William Price
*Assistant Examiner*—R. E. Hart
*Attorney, Agent, or Firm*—Daniel Jay Tick

[57] ABSTRACT

A plurality of recesses are formed in the bottom of a suitcase in spaced relation with each other. A plurality of mounting devices are provided, each movably mounted in a corresponding one of the recesses. Each of a plurality of wheels is rotatably mounted on a corresponding one of the mounting devices. A control system in the suitcase selectively controls the movement of the mounting devices in the recesses in a manner whereby the wheels are spaced from the bottom of the suitcase for supporting the suitcase in one position and are retracted into the recesses in another position.

3 Claims, 4 Drawing Figures

SUITCASE DEVICE

DESCRIPTION OF THE INVENTION

The present invention relates to a suitcase device. More particularly, the invention relates to a suitcase device for a suitcase having a top and a bottom.

Objects of the invention are to provide a suitcase device of simple structure, which is inexpensive in manufacture and functions efficiently, effectively and reliably to considerably enhance the comfort of a user by providing wheels for rolling the suitcase on a supporting surface whenever desired by the user, and retracting such wheels when the suitcase is used in the usual manner.

In order that the invention may be readily carried into effect, it will now be described with reference to the accompanying drawing, wherein.

Figure 1:
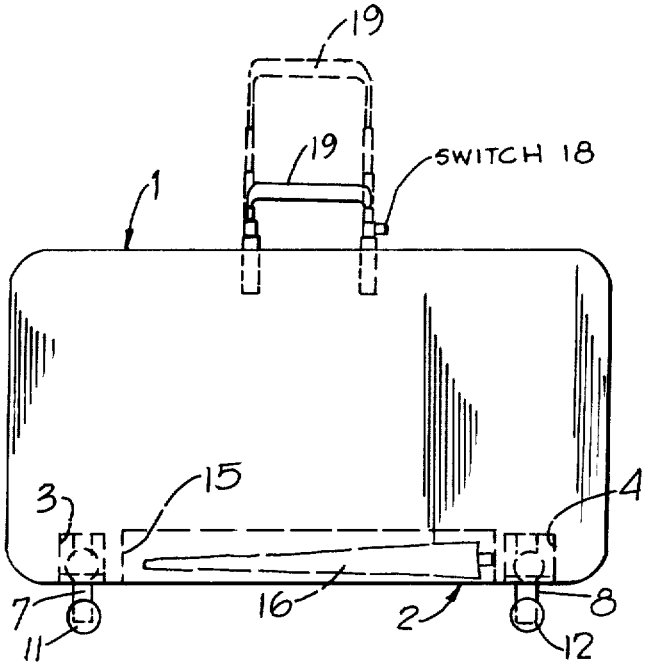
FIG. 1 is a side view of an embodiment of the suitcase device of the invention in extended condition.

The suitcase device of the invention is for a suitcase having a top 1 and a bottom 2 (FIG. 1).

The suitcase device of the invention comprises a plurality of recesses 3, 4 (FIG. 1), 5 and 6 (not shown in the FIGS.) formed in the bottom 2 of a suitcase in spaced relation with each other.

Figure 2:
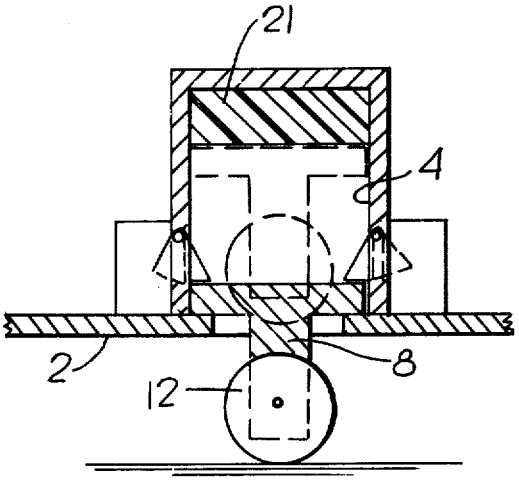
FIG. 2 is a view, partly in section, on an enlarged scale, of part of the control system of the suitcase device of the invention.

A plurality of mounting devices 7, 8 (FIG. 1), 9 and 10 (not shown in the FIGS.) are provided. The mounting device 7 is mounted in the recess 3 (FIG. 1). The mounting device 8 is mounted in the recess 4 (FIGS. 1 and 2). The mounting device 9 is mounted in the recess 5 (not shown in the FIGS.). The mounting device 10 is mounted in the recess 6 (not shown in the FIGS.).

A wheel 11 is rotatably mounted on the mounting device 7 (FIG. 1). A wheel 12 is rotatably mounted on the mounting device 8 (FIGS. 1 and 2). A wheel 13 is rotatably mounted on the mounting device 9 (not shown in the FIGS.). A wheel 14 is rotatably mounted on the mounting device 10 (not shown in the FIGS.).

An additional recess 15 is formed in the bottom 2 of the suitcase and an umbrella 16 is stored therein (FIG. 1).

A control system in the suitcase selectively controls the movement of the mounting devices 7, 8, 9 and 10 in the recesses 3, 4, 5 and 6, respectively, in a manner whereby the wheels 11, 12, 13 and 14 are spaced from the bottom 2 of the suitcase for supporting said suitcase in one position, shown in FIGS. 1 and 2, and are retracted into the recesses in another position, shown by broken lines in FIGS. 1 and 2.

Figure 4:
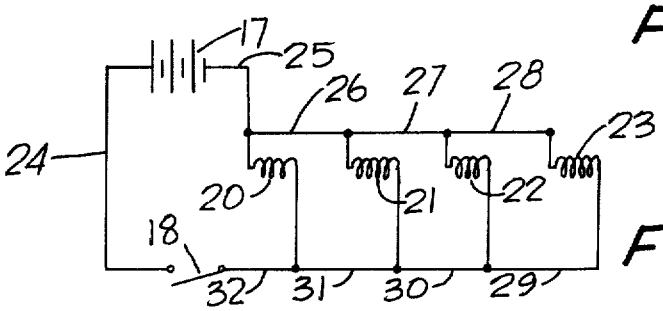
FIG. 4 is a circuit diagram of the suitcase device of the invention.

The control system comprises a source of electrical energy 17 of any suitable type such as, for example, any desired type of battery or batteries, as shown in FIG. 4.

Figure 3:
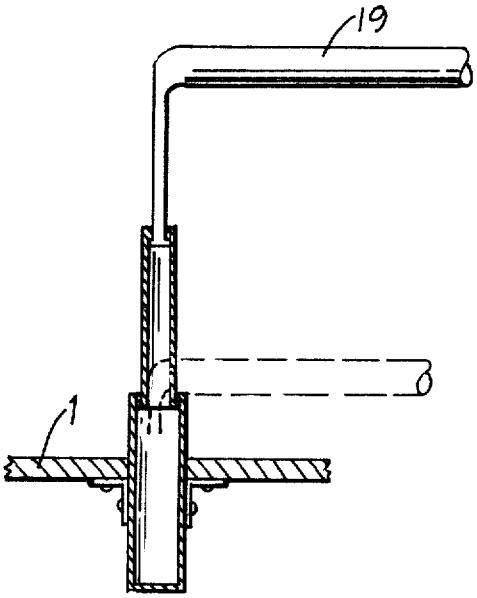
FIG. 3 is a view, partly in section, on an enlarged scale, of the handle of the suitcase device of the invention.

A switch 18 (FIGS. 1 and 4) is mounted at a telescopic handle 19 (FIGS. 1 and 3) extending from the top 1 of the suitcase. The telescopic handle 19 permits the adjustment of the handle to enable people of different heights to carry or roll the suitcase with comfort and facility. The handle 19 may thus be close to the top 1 of the suitcase, as shown by solid lines in FIG. 1 and by broken lines in FIG. 3, or may be adjusted to a position farther from the top of the suitcase, as shown by broken lines in FIG. 1 and solid lines in FIG. 3.

The control system further comprises a plurality of electromagnets 20, 21, 22 and 23 (FIG. 4). The electromagnet 20 is in operative proximity with the mounting device 7. The electromagnet 21 is in operative proximity with the mounting device 8 (FIG. 2). The electromagnet 22 is in operative proximity with the mounting device 9. The electromagnet 23 is in operative proximity with the mounting device 10.

An electrical circuit 24, 25, 26, 27, 28, 29, 30, 31, 32 electrically connects the source of electrical energy 17, plurality of electromagnets 20, 21, 22 and 23 and the switch 18 in circuit, as shown in FIG. 4. Thus, when the switch 18, which is preferably a push-button, is closed, the wheels 11, 12, 13 and 14 are retracted, and when said switch is open, said wheels are extended on their mounting devices and the suitcase may be rolled on a supporting surface.

While the invention has been described by means of a specific example and in a specific embodiment, I do not wish to be limited thereto, for obvious modifications will occur to those skilled in the art without departing from the spirit and scope of the invention.

I claim:

1. A suitcase device for a suitcase having a top and a bottom, said suitcase device comprising a plurality of recesses formed in the bottom of a suitcase in spaced relation with each other;

a plurality of mounting means each movably mounted in a corresponding one of the recesses;

a plurality of wheels each rotatably mounted on a corresponding one of the mounting means; and control means in the suitcase for selectively controlling the movement of the mounting means in the recesses in a manner whereby the wheels are spaced from the bottom of the suitcase for supporting said suitcase in one position and are retracted into the recesses in another position, said control means comprises a source of electrical energy, a switch mounted at the handle, a plurality of electromagnets each in operative proximity with a corresponding one of the mounting means and circuit means electrically connecting the source of electrical energy, plurality of electromagnets and switch in circuit.

2. A suitcase device as claimed in claim 1, further comprising a telescopic handle extending from the top of the suitcase.

3. A suitcase device as claimed in claim 2, further comprising an additional recess formed in the bottom of the suitcase and an umbrella stored therein.

* * * * *